US006951194B2

(12) United States Patent
Nishikawa et al.

(10) Patent No.: US 6,951,194 B2
(45) Date of Patent: Oct. 4, 2005

(54) COMBUSTION TYPE POWER TOOL

(75) Inventors: Tomomasa Nishikawa, Hitachinaka (JP); Shinki Ohtsu, Hitachinaka (JP); Yasuki Ohmori, Hitachinaka (JP)

(73) Assignee: Hitachi Koki Co., LTD, Tokyo (JP)

( * ) Notice: Subject to any disclaimer, the term of this patent is extended or adjusted under 35 U.S.C. 154(b) by 44 days.

(21) Appl. No.: 10/775,189

(22) Filed: Feb. 11, 2004

(65) Prior Publication Data

US 2004/0164117 A1 Aug. 26, 2004

(30) Foreign Application Priority Data

Feb. 21, 2003 (JP) ..... P2003-044863

(51) Int. Cl.[7] ..... B25C 1/04
(52) U.S. Cl. ..... 123/46 R; 227/10
(58) Field of Search ..... 123/46 R, 46 SC, 123/46 A, 46 B, 46 E; 227/8, 10, 130

(56) References Cited

U.S. PATENT DOCUMENTS 4,256,071 A * 3/1981 Casull ..... 123/266
5,197,646 A 3/1993 Nikolich
6,584,945 B2 7/2003 Porth
2001/0006046 A1 7/2001 Thieleke et al.

FOREIGN PATENT DOCUMENTS

EP 1 053 834 A2 11/2000
JP 3-25307 4/1991

* cited by examiner

*Primary Examiner*—Henry C. Yuen
*Assistant Examiner*—Hyder Ali
(74) *Attorney, Agent, or Firm*—Antonelli, Terry, Stout and Kraus, LLP.

(57) ABSTRACT

A combustion-type power tool capable of preventing a sub-stream of air-fuel mixture from passing through a gap between an electrode and an opposing electrode section, and yet capable of providing a desirable ignition without lowering maintenance efficiency of the tool. The opposing electrode section opposes the electrode of an ignition plug body. A head cap supports the opposing electrode section at a position closer to an axis of a fan than the electrode to the axis. The opposing electrode section protrudes from the head cap outward in the radial direction of the fan. The side of the head cap defining a combustion chamber has three parts. A first part surrounds the rotation axis of the fan. A second part supports the ignition plug body. A third part located in the radially outer side of the second section with respect to the axis.

3 Claims, 3 Drawing Sheets

COMBUSTION TYPE POWER TOOL

BACKGROUND OF THE INVENTION

The present invention relates to a combustion-type power tool, and more particularly, to a combustion-type fastener driving tool in which combustible gas is ejected from a gas canister into a combustion chamber, mixed with air and ignited to drive a piston, thus generating power to drive nails or the like.

FIG. 3 illustrates a conventional combustion-type driving tool 101. The tool 101 generally includes a housing 102, a head cap 104, a combustion-chamber frame 106, a push lever (not shown), a cylinder 103, a piston 109, a driver blade (not shown), a motor 112, a fan 113, a gas canister (not shown), an ignition plug body 116, an exhaust-gas check valve (not shown), a magazine (not shown), and a tail cover (not shown). The head cap 104 is positioned in the housing 102. The combustion-chamber frame 106 is movable in the housing 102 in the lengthwise direction thereof. One end of the frame 106 is abutable on the head cap 104. The push lever is movably provided at the other end of the housing and is coupled to the combustion-chamber frame 106. The cylinder 103 is secured to the housing 102 in communication with the combustion-chamber frame 106. The cylinder 103 guides the movement of the combustion-chamber frame 106 and is formed with an exhaust port. The piston 109 is reciprocally movable in the cylinder 103. While the combustion-chamber frame 106 has its one end abutting on the head cap 104, the piston 109 defines a combustion chamber 111 in cooperation with the head cap 104, the combustion-chamber frame 106 and the end portion of the cylinder 103, the end portion being positioned near the head cap. The driver blade extends from the end of the piston 109 which faces away from the combustion chamber 111 toward the other end of the housing 102. The motor 112 is supported on the head cap 104. The fan 113 is fastened to the motor 112 and provided in the combustion chamber 111. The gas canister is assembleable in the housing 102 and contains combustible gas that is to be ejected into the combustion chamber 111 through a gas passage formed in the head cap 104. The ignition plug body 116 is faced to the combustion chamber 111 to ignite a mixture of combustible gas and air. The exhaust-gas check valve selectively closes the exhaust port. The magazine is positioned at the other end of the housing 102 and contains fastening elements such as nails. The tail cover is interposed between the magazine and the push lever to supply the fastener from the magazine to a position of a moving locus of the driver bit.

The combustible gas is ejected into the combustion chamber 111 from the gas canister assembled in the housing 102. In the combustion chamber 111, the combustible gas and air are stirred and mixed together by the fan 113. The ignition plug body 116 ignites the resultant mixture gas. The mixture gas explodes to drive piston 109 for driving the driver blade, which in turn drives nails into a workpiece such as a wood block. Such conventional power tool is disclosed in U.S. Pat. No. 5,197,646 and Japanese Patent Publication No. Hei 3-25307.

The combustion-type driving tools disclosed in these publications provide a head cap 104 having a structure as shown in FIG. 4. In the combustion-type driving tool of FIG. 4, the ignition space is positioned in a displaced position, while communicating with the main combustion space. Thus, static state of the gas mixture can be obtained in the main combustion space by restraining wind pressure due to a flow of the gas mixture, in order to prevent the ignited flame from being puffed out. More specifically, the head cap 104 surface part defining a part of the combustion chamber includes a first part 104A, a second part 104B and a third part 104C. The first part 104A lies around an axis 113*a* of the fan 113. The second part 104B supports the ignition plug body 116. The third part 104C lies at an outer side of the second part 104B in the radial direction of the fan 113. An electrode 116A of the plug 116 is positioned at the second part 104B of the head cap 104. The second part 104B is located farther from the piston 109 than the first and third parts 104A, 104C to the piston 109. The second part 104B defines a projecting space 104*a* functioning as an ignition space.

The electrode 116A of the ignition plug body 116 and an opposing electrode section 156 oppose to each other. The electrode section 156 has a protruding section protruding around the axis 113*a* and in a circumferential direction of the fan 113. By virtue of this positional relation between the electrode 116A and the opposing electrode section 156, a main stream A and a sub-stream B develop in the combustion chamber 111 as shown in FIG. 3, when the fan 113 is rotated and stirs and mixes the combustible gas with air in a sealed state of the combustion chamber 111. As a result, the sub-stream B passes through a gap between the electrode 116A and the opposing electrode section 156 as illustrated in FIG. 4. The sub-stream B much hinders the ignition of the combustible gas. The sub-stream B becomes particularly intensified when the rotation speed of the fan 113 is increased in order to improve output or scavenging efficiency. In the latter case, ignition to the gas-fuel mixture becomes more difficult.

A cover may be provided to cover both the electrode 116A and the opposing electrode section 156 to improve ignitability of the gas-fuel mixture. However, this not only increases the number of components of the combustion-type driving tool to increase production cost, but also makes it troublesome to clean the interior of the combustion chamber. Thus, maintenance to the combustion chamber becomes degraded.

SUMMARY OF THE INVENTION

It is an object of the present invention to provide a combustion-type power tool capable of preventing the sub-stream from passing through the gap between the electrode and the opposing electrode section, and yet capable of providing a desirable ignition without lowering the maintenance efficiency of the tool.

This and other objects of the present invention will be attained by a combustion-type power tool including a housing, a head section, a combustion chamber frame, a cylinder, a piston, a motor, a fan, an ignition plug body, and an opposing electrode section. The head section closes the one end of the housing and is formed with a gas passage having one end functioning as a gas injection port for ejecting combustible gas and another end in communication with a gas canister. The combustion-chamber frame is provided in the housing and movable in a lengthwise direction of the housing. The combustion-chamber frame has one end abuttable on the head section. The cylinder is secured to the housing and is in communication with an interior of the combustion-chamber frame. The cylinder guides the movement of the combustion-chamber frame. The piston is reciprocally movable with respect to the cylinder. A combination of the piston, the head section, the combustion-chamber frame and a head section side of the cylinder defines a combustion chamber when the one end of the combustion-chamber frame abuts on the head section. The motor is supported on the head section. The fan is secured to the motor and is positioned in the combustion chamber. The fan is rotatable about a rotation axis. The ignition plug body is supported by the head section and has an electrode positioned in the combustion chamber for igniting a mixture of air and the combustible gas. The opposing electrode section is provided in the combustion chamber and is located closer to the head section than the fan to the head section. The opposing electrode section opposes to the electrode for generating a spark therebetween. The opposing electrode section is supported by the head section at a supporting position positioned closer to the axis of the fan than the electrode to the axis of the fan, and the opposing electrode section protrudes outwardly from the supporting position in a radial direction of the rotation axis.

By the rotation of the fan, a mixture of air and combustible gas is circularly moved in the combustion chamber as a main stream. Further, a sub-stream is generated upon generation of the main stream. The sub-stream can flow along the bottom surface of the opposing electrode section, and cannot be entered into the ignition space defined between the electrode and the opposing electrode section. Thus, the sub-stream does not flow across the ignited flame generated between the electrode and the opposing electrode section. Consequently, desirable ignition can result. Further, because the opposing electrode section can serve as a shielding member, maintenance to the ignition area can be facilitated without increase in numbers of components.

Preferably, the head section has a combustion chamber defining surface which at least includes a first part surrounding the rotation axis of the fan, a second part supporting the ignition plug body, and a third part located radially outer side of the second part in the radial direction of the rotation axis of the fan. The electrode of the ignition plug body is located at the second part. Further, the second part is located farther from the piston than the first and third parts to the piston for providing a protruding ignition space. Further, the opposing electrode section has an opposing surface in opposition to the piston, the opposing surface being flush with the third part in the radial direction of the fan. With this arrangement, the opposing electrode section can efficiently shield the ignition space without disturbing the flow of sub-stream. Thus, desirable ignition can be obtained.

Alternatively, the opposing electrode section has an opposing surface in opposition to the piston, the opposing surface being positioned farther from the piston than the third part to the piston in the radial direction of the fan. This structure can further prevent or restrain the main stream flowing along the third part toward the rotation axis of the fan from entering into the ignition space.

DETAILED DESCRIPTION OF THE PREFERRED EMBODIMENTS

Figure 1:
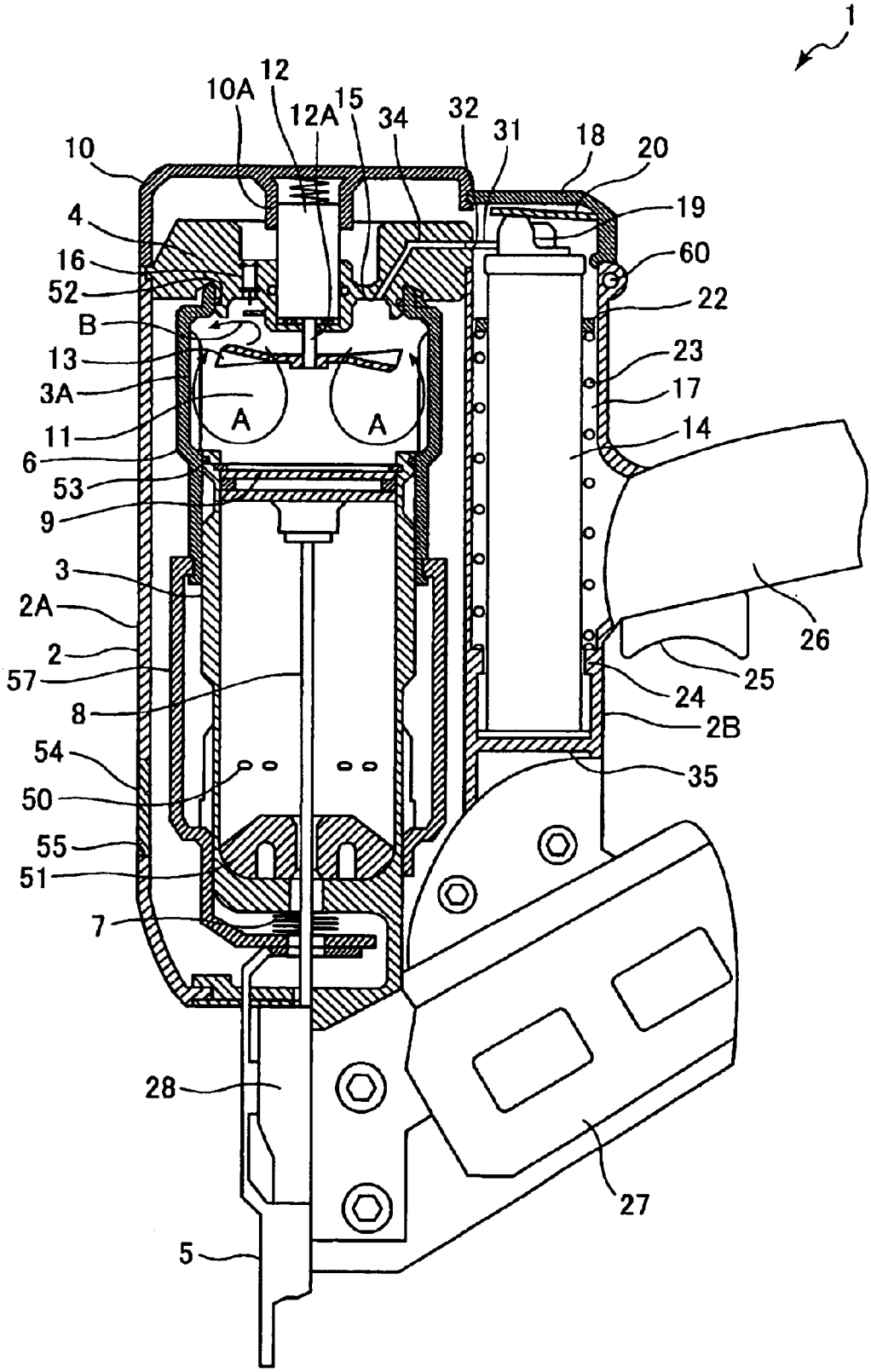
FIG. 1 is a schematic cross-sectional view showing a combustion type nail driver to which a combustion-type power tool according to the present invention is applied.

A combustion-type power tool according to one embodiment of the present invention will be described with reference to FIGS. 1 and 2. The embodiment pertains to a combustion type nail driver. The combustion type nail driver 1 has a housing 2 including a main housing 2A and a canister housing 2B. The canister housing 2B is juxtaposed to the main housing 2A and extends in the lengthwise direction thereof. The main housing 2A has a top portion formed with an intake port (not shown), and a bottom portion formed with an exhaust port 55 in which a filter 54 is supported.

A head cover 10 is mounted on the top of the main housing 2A. The head cover 10 has a motor-supporting section 10A. A storage cover 18 is hingedly mounted on the top of the canister housing 2B through a pin 60 and selectively opens or closes the top of the canister housing 2B. A handle 26 having a trigger switch 25 extends from the canister housing 2B. A magazine 27 and a tail cover 28 are provided on the bottoms of the main housing 2A and canister housing 2B. The magazine 27 contains nails (not shown), and the tail cover 28 is adapted to guide each nail to a predetermined position.

A push lever 5 is movably provided at the lower end of the main housing 2A and is positioned in conformance with a nail setting position defined by the tail cover 28. The push lever 5 is coupled to a coupling member 57 that is secured to a combustion-chamber frame 6 which will be described later. When the entire housing 2 is pressed toward a workpiece while the push lever 5 is in abutment with the workpiece, an upper portion of the push lever 5 is retractable into the main housing 2A.

A head cap 4 is secured to the top of the main housing 2A and closes the open top end of the main housing 2A. The head cap 4 supports a motor 12 having a motor shaft 12A. A fan 13 is coaxially fixed to the motor shaft 12A. The head cap 4 also supports an ignition plug body 16. The motor 12 is driven when the push lever 5 moves upward to a predetermined position. The head cap 4 has a canister housing side in which is formed an ejection passage 34 which allows a combustible gas to pass therethrough. One end of the ejection passage 34 serves as an ejection port 15 that opens at the lower surface of the head cap 4. Another end 32 of the ejection passage 34 is communicated with a gas canister 14 which will be described later. The head cap 4 has a seal 52 for providing a seal between the head cap 4 and an upper end of the combustion-chamber frame 6 when the upper end of the combustion-chamber frame 6 abuts on the head cap 4.

The combustion-chamber frame 6 is provided in the main housing 2A and is movable in the lengthwise direction of the main housing 2A. The uppermost end of the combustion-chamber frame 6 is abuttable on the lower surface of the head cap 4. The coupling member 57 described above is secured to the lower end of the combustion-chamber frame 6 and is connected to the push lever 5. A cylinder 3 is fixed to the main housing 2A. The inner circumference of the combustion-chamber frame 6A is in sliding contact with an outer peripheral surface of the cylinder 3 for guiding the movement of the combustion-chamber frame 6. A compression coil spring 7 is interposed between the lower end of the cylinder 3 and the lower end of the coupling member 57 for biasing the combustion-chamber frame 6 in a direction away from the head cap 4. The cylinder 3 has a lower portion formed with an exhaust hole 50 in fluid communication with the above-mentioned exhaust port 55. An exhaust-gas check valve (not shown) is provided to selectively close the exhaust hole 50. A bumper 51 is provided on the bottom of the cylinder 3. A seal 53 is provided on the top of the cylinder 3 to provide a seal between the inner circumference of the lower part of the combustion-chamber frame 6 and the outer circumference of the upper part of the cylinder 3 when the combustion-chamber frame 6 abuts on the head cap 4.

A piston 9 is slidably and reciprocally provided in the cylinder 3. When the upper end of the combustion-chamber frame 6 abuts on the head cap 4, the head cap 4, the combustion-chamber frame 6, the upper portion of the cylinder 3, the piston 9 and the seals 52 and 53 define in combustion a combustion chamber 11. A plurality of ribs 3A are provided on the inner peripheral portion of the combustion-chamber frame 6 which defines the combustion chamber 11. The ribs 3A extend in the lengthwise direction of the main housing 2A and project radially inwardly toward the axis of the main housing 2A. The ribs 3A cooperate with the fan 13 to promote the stirring and mixing of air with the combustible gas in the combustion chamber 11. The above-mentioned intake port (not shown) is adapted to supply air into the combustion chamber 11, and the exhaust hole 50 and the exhaust port 55 are adapted to exhaust the combusted gas from the combustion chamber 11.

A driver blade 8 extends downwards from a side of the piston 9, the side being opposite to the combustion chamber 11 to the lower end of the main housing 2A. The driver blade 8 is positioned coaxially with the nail setting position in the tail cover 28, so that the driver blade 8 can strike aginst the nail. When the piston 9 moves downward, the piston 9 abuts on the bumper 51 and stops.

The fan 13 is provided in the combustion chamber 11, and the ignition plug body 16 and the ejection port 15 are respectively exposed and open to the combustion chamber 11. Rotation of the fan 13 performs the following three functions. First, the fan 13 stirs and mixes the air with the combustible gas as long as the combustion-chamber frame 6 remains in abutment with the head cap 4. Second, after the mixed gas has been ignited, the fan 13 causes turbulence of the air-fuel mixture, thus promoting the combustion speed of the air-fuel mixture in the combustion chamber 11. Third, the fan 13 performs scavenging such that the exhaust gas in the combustion-chamber 11 can be scavenged therefrom when the combustion-chamber frame 6 moves away from the head cap 4.

Figure 2:
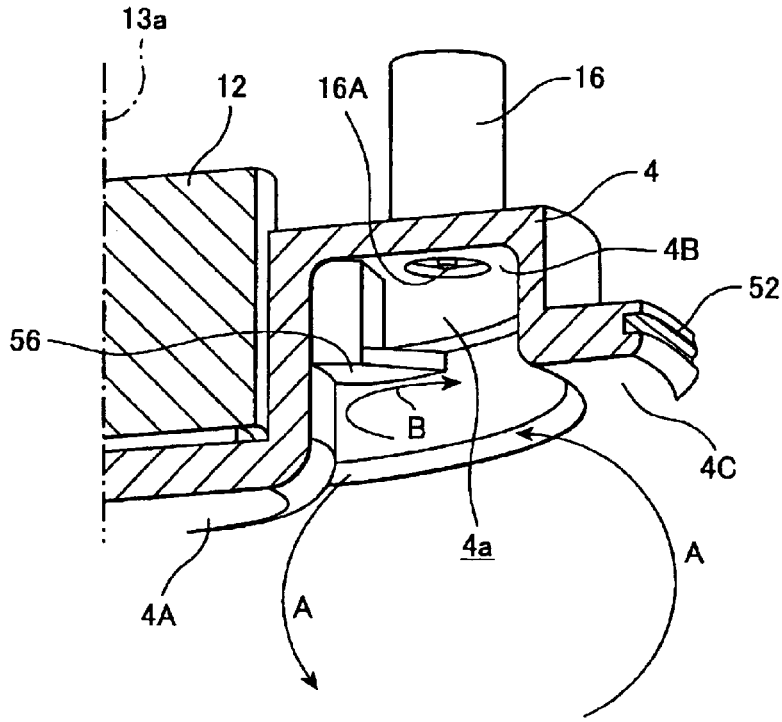
FIG. 2 is a partially sectional, perspective view showing a part of the nail driver, representing the shape of the head cap and a flowing manner of a gas mixture at an ignition region.
Figure 3:
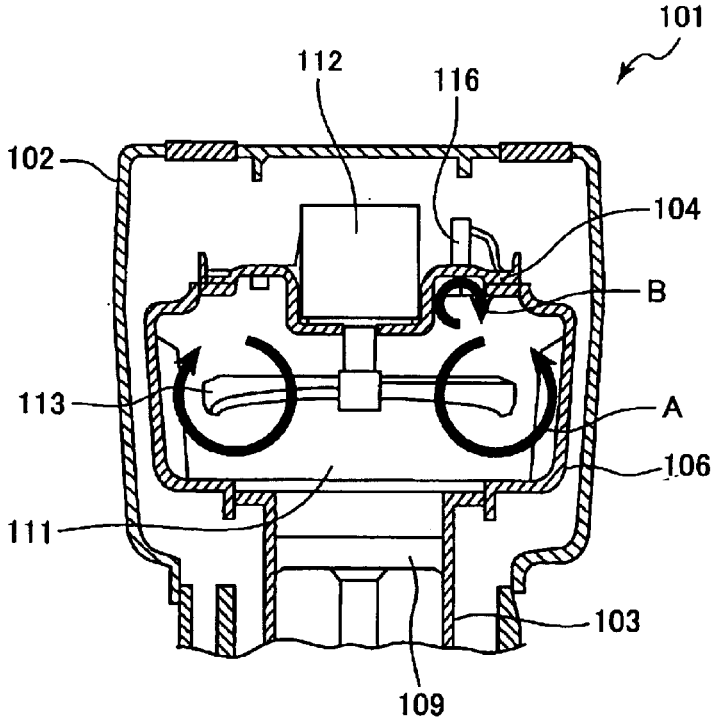
FIG.3 PRIOR ART
FIG. 3 is a schematic cross-sectional view showing a conventional combustion type nail driver, and particularly showing the combustion chamber thereof.
Figure 4:
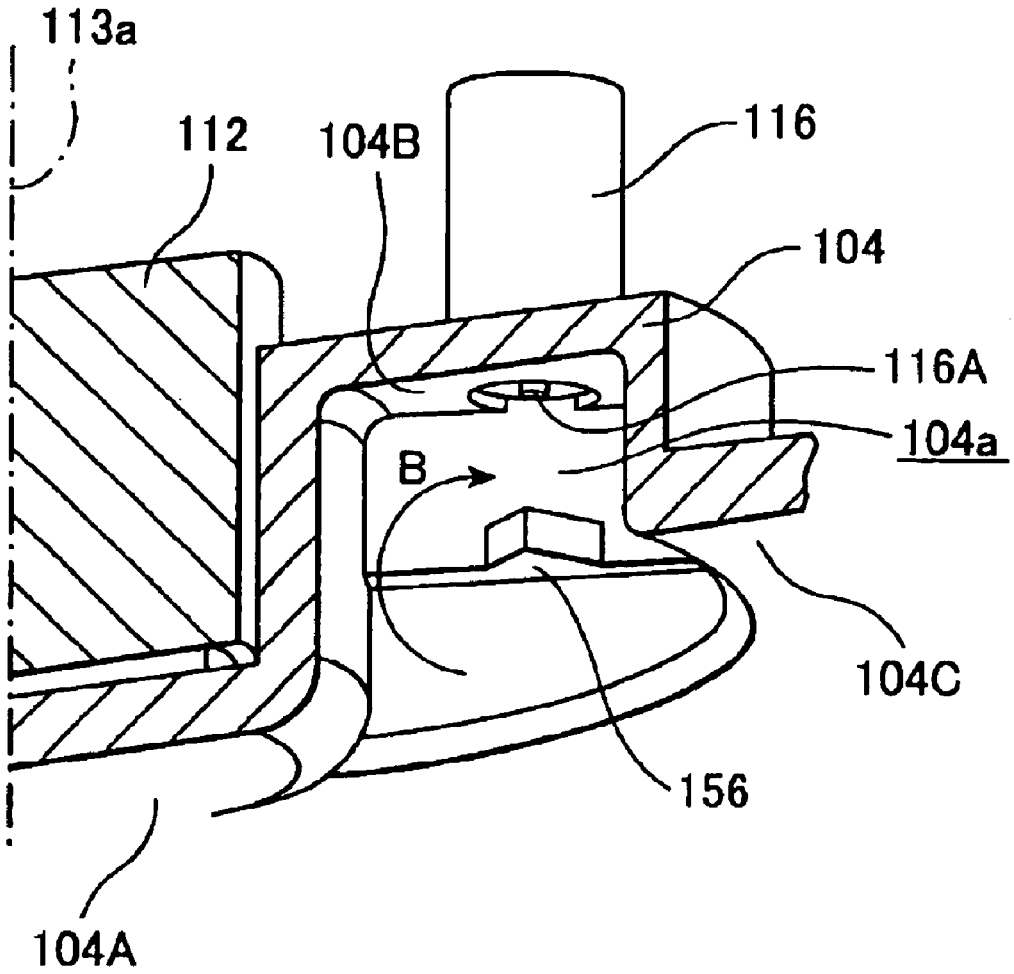
FIG.4 PRIOR ART
FIG. 4 is a perspective view showing the conventional combustion type nail driver, representing the shape of the head cap near the ignition area.

As FIG. 2 shows, the side of the head cap 4 that defines the combustion chamber 11 has at least a first part 4A, a second part 4B and a third part 4C. The first part 4A lies around an axis 13*a* of the fan 13. The second part 4B supports the ignition plug body 16. The third part 4C is positioned at a radially outer side of the second part 4B with respect to the axis 13*a* of the fan 13. An electrode (for example, an anode) 16A of the ignition plug body 16 is positioned at the second part 4B. The second part 4B is located farther from the piston 9 than the first and third parts 4A and 4C to the piston 9, so that the second part 4B defines a protruding portion functioning as an ignition space 4*a*. The protruding ignition space 4*a* has a sufficient depth so that the ignition spark cannot be blown off by the main stream (i.e., swirling or circulating flow) of the air-fuel mixture developed in the combustion chamber 11 by the rotating fan 13.

An opposing electrode section (for example, a cathode) 56 is provided on the head cap 4 at a position in confrontation with the electrode 16A of the ignition plug body 16 for generating a spark in cooperation with the electrode 16A. The opposing electrode section 56 is positioned closer to the head cap 4 than the fan 13 to the head cap. The opposing electrode section 56 is supported by the head cap 4 at a position closer to the axis 13*a* of the fan 13 than the electrode 16A to the axis 13*a*. The opposing electrode section 56 protrudes from the head cap 4 outwardly in the radial direction of the fan 13. The opposing electrode section 56 has a surface in confrontation with the piston 9, and the surface lies flush with the third part 4C of the head cap 4 in the radial direction of the fan 13.

The canister housing 2B has a bottom wall 35. The canister housing 2B and the storage cover 18 define a gas canister chamber 17 in which the gas canister 14 is accommodatable. The canister housing 2B has the lower inner peripheral surface portion provided with a stepped section 24. A compression spring 23 is seated on the stepped section 24. A leaf spring 20 is secured to the storage cover 18 so as to push the gas canister 14 from above.

The gas canister 14 contains liquidized combustible gas. The gas canister 14 has a cap 19 at its top. The cap 19 has a rod 31 for ejecting a predetermined amount of the liquidized gas. An annular member 22 is secured to the outer circumference of the gas canister 14 at a position near the top of the gas canister 14. The above-mentioned compression spring 23 is interposed between the annular member 22 and the stepped section 24 for biasing the gas canister 14 upwards. When the storage cover 18 is closed, the gas canister 14 is pushed down against the biasing force of the compression spring 23 and is positioned in alignment with the ejection passage 34. A cam (not shown) is provided in the housing 2. The cam is angularly rotatable in synchronism with the movement of the push lever 5 by a predetermined moving stroke. Upon rotation of the cam, the gas canister 17 moves, so that the rod 31 is pushed against the open end 32 of the head cap 4. Thus, the liquidized gas in the gas canister 14 can be ejected into the ejection passage 34 through the rod 31.

With this structure, in the non-operational state of the combustion type nail driver 1, the push lever 5 is biased downward by the biasing force of the compression coil spring 7, so that the push lever 5 protrudes from the lower end of the tail cover 28. Thus, the uppermost end of the combustion-chamber frame 6 is spaced away from the head cap 4 because the coupling member 57 couples the combustion-chamber frame 6 to the push lever 5. Further, a part of the combustion-chamber frame 6 which part defines the combustion chamber 11 is also spaced from the top portion of the cylinder 3. Hence, a gap is provided between the head cap 4 and the combustion chamber frame 6, and a gap is also provided between the top of the cylinder 3 and the frame 6. In this condition, the piston 9 stays at the top dead center in the cylinder 3.

With this state, if the push lever 5 is pushed onto the workpiece such as a wood block while holding the handle 26 by a user, the push lever 5 is moved upward against the biasing force of the compression coil spring 7. At the same time, the combustion-chamber frame 6 which is coupled to the push lever 5, is also moved upward, closing the above-described gaps between the head cap 4 and the combustion-chamber fame 6 and between the cylinder 3 and the frame 6. Thus, the sealed combustion chamber 11 is provided by the seals 52 and 53. Upon elapse of a predetermined time period after the push lever 5 is pushed onto the workpiece, the gas canister 14 is pushed and the combustible gas is ejected into the combustion chamber 11 through the ejection port 15. Further, the motor 12 is turned on at the same time, rotating the fan 13. The fan 13 and the ribs 3A protruding into the combustion chamber 11 cooperate, stirring and mixing the combustible gas with air in the combustion chamber 11.

As shown in FIG. 2, when the fan 13 is rotated, the gas mixture flows in the combustion chamber 11 in the directions of arrows A and B, forming a main stream and a sub-stream, respectively. The main stream A goes first downward, then upward along the top side of the piston 9 and the inner surface of the combustion-chamber frame 6, and further along the third part 4C of the head cap 4. Thus, the main stream A is a swirl or circulating flow directing toward the axis of the fan 13. Here, as described above, the surface of the third part 4C of the head cap 4 lies flush with the bottom surface of the opposing electrode section 56. This prevents or restrains the main stream A or circulating flow from moving into the projecting space 4*a*. Accordingly, miss firing due to wind pressure by the circulating flow can be prevented. In other words, increase in gas mixture flowing speed at a space between the electrode 16A and the opposing electrode section 56 can be eliminated. This ensures desirable ignition of the gas mixture. This is particularly effective for providing a power tool capable of generating a greater output. In the latter case, the fan 13 should be rotated at higher speed, which in turn causes increase in flowing speed of the main stream A. Nevertheless, the above-described flush arrangement can prevent such a high-speed swirl of gas mixture from entering the protruding ignition space 4*a*. Consequently, the gas mixture in the protruding ignition space 4*a* can therefore be ignited in a desirable manner.

The sub-stream B is also developed when the main stream A is generated. The sub-stream B is directed upwardly along the vertical wall that connects the fist part 4A to the second part 4B of the head cap 4. As described above, the opposing electrode section 56 is supported by the head cap 4 at a position closer to the axis 13*a* of the fan 13 than the electrode 16A to the axis 13*a*, and, the opposing electrode section 56 protrudes outward in the radial direction of the fan 13. Hence, the sub-stream flows along the bottom surface of the opposing electrode section 56 and cannot flow into the protruding ignition space 4*a*. In other words, the sub-stream B cannot flow across the ignited flame generated in the gap between the electrode 16A and the opposing electrode section 56. Further, since the bottom surface of the opposing electrode section 56 opposing to the piston 9 lies flush with the third part 4C of the head cap 4, the sub-steam B can flow smoothly along the bottom surface and the third part 4C without any turbulence. In other words, the bottom surface of the opposing electrode section 56 can effectively prevent the sub-stream B from being disturbed, which ensures desirable ignition of the gas mixture.

Then, when the user turns on the trigger switch 25 at the handle 26, the ignition plug body 16 generates a spark, which ignites the gas mixture. At this time, the fan 13 keeps rotating, promoting the turbulent combustion of the gas mixture. This enhances the output of the power tool. The combusted and expanded gas pushes the piston 9 downward. Therefore, a nail in the tail cover 28 is driven into the workpiece through the driver blade 8 until the piston 9 abuts on the bumper 7.

As the piston 9 passes by the exhaust hole 50, the check valve (not shown) opens the exhaust hole 50 because of the application of the combustion gas pressure to the check valve. Therefore the combustion gas is discharged from the cylinder 3 through the exhaust hole 50 and then discharged outside through the filter 54 and exhaust port 55. The check valve is closed when the pressure in the cylinder 3 and combustion chamber 11 is restored to the atmospheric pressure as a result of the discharge. Combustion gas still remaining in the cylinder 3 and the combustion chamber 11 has a high temperature at a phase immediately after the combustion. However, the high temperature can be absorbed into the walls of the cylinder 3 and the combustion-chamber frame 6 to rapidly cool the combustion gas. Thus, the pressure in the sealed space in the cylinder 3 further drops to less than the atmospheric pressure (creating a so-called "thermal vacuum"). Accordingly, the piston 9 is moved back to the initial top dead center in the cylinder 3 by virtue of the pressure difference between the internal pressure in the combustion chamber 11 and the pressure in the lower part of the cylinder 3 lower than the piston 9.

Then, the user turns off the trigger switch 25 and lifts the combustion type nail driver 1 from the workpiece and the push lever 5 is separated from the workpiece. As a result, the push lever 5 and the combustion-chamber frame 6 move downward due to the biasing force of the compression coil spring 7. The above-mentioned gaps are provided again. The fan 13 keeps rotating for a predetermined time period after the trigger switch 25 is turned off. Thus, fresh air flows into the combustion chamber 11 through the intake port and through the gaps, expelling the residual gas through the exhaust port 55. Thus, the combustion chamber 11 is scavenged. Then, the fan 13 stops rotating, and the combustion type nail driver 1 restores the initial state.

The combustion-type power tool according to the present invention is not limited to the above-described embodiment, but various changes and modifications can be made within the scope of the invention, which is defined by the claims. For example, in the above-described embodiment, the bottom surface of the opposing electrode section 56 opposing to the piston 9 is flush with the third part 4C in the radial direction of the fan 13. However, the bottom surface of the opposing electrode section 56 opposing to the piston 9 can be positioned farther from the piston 9 than the third part 4C to the piston 9. This structure can further reduce a probability of entering the main stream flowing along the third part 4C into the protruding ignition space 4*a*.

Moreover, in the above-described embodiment, the combustion-chamber frame 6 is connected to the push lever 5 through the separate coupling member 57. However, the combustion-chamber frame 6 and the coupling member 57 can be formed integrally with each other as a single unit, and this unit can be coupled to the push lever 5.

What is claimed is:

1. A combustion-type power tool comprising:

a housing having one end;

a head section closing the one end of the housing and formed with a gas passage having one end functioning as a gas injection port for ejecting combustible gas and another end in communication with a gas canister;

a combustion-chamber frame provided in the housing and movable in a lengthwise direction of the housing, the combustion-chamber frame having one end abuttable on the head section;

a cylinder secured to the housing and in communication with an interior of the combustion-chamber frame, the cylinder guiding the movement of the combustion-chamber frame;

a piston reciprocally movable with respect to the cylinder, a combination of the piston, the head section, the combustion-chamber frame and a head section side of the cylinder defining a combustion chamber when the one end of the combustion-chamber frame abuts on the head section;

a motor supported on the head section;

a fan secured to the motor and positioned in the combustion chamber, the fan being rotatable about a rotation axis;

an ignition plug body supported by the head section and having an electrode positioned in the combustion chamber for igniting a mixture of air and the combustible gas; and an opposing electrode section provided in the combustion chamber and located closer to the head section than the fan to the head section, the opposing electrode section opposing to the electrode for generating a spark therebetween;

wherein the opposing electrode section is supported by the head section at a supporting position positioned closer to the axis of the fan than the electrode to the axis of the fan, and the opposing electrode section protruding outwardly from the supporting position in a radial direction of the rotation axis.

2. The combustion-type power tool as claimed in claim 1, wherein the head section has a combustion chamber defining surface which at least includes a first part surrounding the rotation axis of the fan, a second part supporting the ignition plug body, and a third part located radially outer side of the second part in the radial direction of the rotation axis of the fan;

wherein the electrode of the ignition plug body is located at the second part;

wherein the second part is located farther from the piston than the first and third parts to the piston for providing a protruding ignition space; and wherein the opposing electrode section has an opposing surface in opposition to the piston, the opposing surface being flush with the third part in the radial direction of the fan.

3. The combustion-type power tool as claimed in claim 1, wherein the head section has a combustion chamber defining surface which at least includes a first part surrounding the rotation axis of the fan, a second part supporting the ignition plug body, and a third part located radially outer side of the second part in the radial direction of the rotation axis of the fan;

wherein the electrode of the ignition plug body is located at the second part;

wherein the second part is located farther from the piston than the first part and the third part to the piston for providing a protruding ignition space;

wherein the opposing electrode section has an opposing surface in opposition to the piston, the opposing surface being positioned farther from the piston than the third part to the piston in the radial direction of the fan.

* * * * *